US009719450B2

(12) United States Patent
Miyaura et al.

(10) Patent No.: US 9,719,450 B2
(45) Date of Patent: Aug. 1, 2017

(54) METHOD AND APPARATUS FOR DIAGNOSING A FUEL PRESSURE SENSOR

(71) Applicants: Takeshi Miyaura, Toyota (JP); Yoshiyasu Ito, Toyota (JP); Nobuyoshi Takigawa, Kariya (JP)

(72) Inventors: Takeshi Miyaura, Toyota (JP); Yoshiyasu Ito, Toyota (JP); Nobuyoshi Takigawa, Kariya (JP)

(73) Assignees: Toyota Jidosha Kabushiki Kaisha, Toyota-shi, Aichi-ken (JP); Denso Corporation, Kariya-shi, Aichi-ken (JP)

( * ) Notice: Subject to any disclaimer, the term of this patent is extended or adjusted under 35 U.S.C. 154(b) by 510 days.

(21) Appl. No.: 14/384,466

(22) PCT Filed: Mar. 7, 2013

(86) PCT No.: PCT/IB2013/000303
§ 371 (c)(1),
(2) Date: Sep. 11, 2014

(87) PCT Pub. No.: WO2013/136147
PCT Pub. Date: Sep. 19, 2013

(65) Prior Publication Data

US 2015/0112575 A1 Apr. 23, 2015

(30) Foreign Application Priority Data

Mar. 12, 2012 (JP) ..... 2012-054803

(51) Int. Cl.
*F02D 41/22* (2006.01)
*F02D 41/14* (2006.01)
(Continued)

(52) U.S. Cl.
CPC ..... *F02D 41/222* (2013.01); *F02D 41/1443* (2013.01); *F02D 41/263* (2013.01); *F02D 41/3809* (2013.01); *F02D 2041/223* (2013.01)

(58) Field of Classification Search
CPC ..... F02D 41/222; F02D 2014/223; F02D 2041/227; F02D 2200/0602;
(Continued)

(56) References Cited

U.S. PATENT DOCUMENTS 9,200,975 B2 * 12/2015 Hattar ..... F02D 41/222
2004/0083048 A1 * 4/2004 Wolber ..... F02D 41/222 701/114
(Continued)

FOREIGN PATENT DOCUMENTS

EP 1 923 255 A1 5/2008
JP 2008-128307 6/2008
(Continued)

*Primary Examiner* — Stephen K Cronin
*Assistant Examiner* — Anthony L Bacon
(74) *Attorney, Agent, or Firm* — Finnegan, Henderson, Farabow, Garrett & Dunner, LLP

(57) ABSTRACT

A device executes a power limiting process when the number of pressure sensors determined to be normal in a second determination process made by a second processing unit is smaller than or equal to one. When only one pressure sensor is determined to be normal through the second determination process, and when that pressure sensor and a pressure sensor connected to only a first processing unit are determined to be normal in a first determination process made by the first processing unit, a process associated with fuel injection based on a detected value of the pressure sensor determined to be normal in the second determination process is executed, and a degree of limiting engine power through the power limiting process is reduced as compared
(Continued)

with when both the pressure sensors are determined to be abnormal in the first determination process.

6 Claims, 7 Drawing Sheets

(51) Int. Cl.
*F02D 41/38* (2006.01)
*F02D 41/26* (2006.01)

(58) Field of Classification Search
CPC ..... F02D 200/0604; F02D 2250/31; F02M 65/003; F02M 2200/247
See application file for complete search history.

(56) References Cited

U.S. PATENT DOCUMENTS

| | | | | |
|---|---|---|---|---|
| 2008/0228374 | A1 | 9/2008 | Ishizuka et al. | |
| 2009/0082941 | A1 * | 3/2009 | Nakata ..... | F02D 41/222 701/103 |

FOREIGN PATENT DOCUMENTS

| | | | | |
|---|---|---|---|---|
| JP | 2008-144749 | | 6/2008 | |
| JP | 5949578 | B2 * | 7/2016 | ..... F02D 41/3836 |

* cited by examiner

FIG. 7

| EXECUTION MODE | DETERMINATION RESULT OF FIRST DETERMINATION PROCESS | | | | MANNER OF EXECUTING INJECTION PRESSURE CONTROL | MANNER OF EXECUTING POWER LIMITING CONTROL |
|---|---|---|---|---|---|---|
| | #1 | #2 | #3 | #4 | | |
| A | × | – | – | × | USE TARGET FUEL PRESSURE INSTEAD OF FUEL PRESSURE PQ | DEGREE OF LIMITING ENGINE POWER IS "LARGE" |
| B | ○ | × | × | × | USE DETECTED VALUE OF PRESSURE SENSOR 51[#1] | DEGREE OF LIMITING ENGINE POWER IS "SMALL" |
| | × | × | × | ○ | USE DETECTED VALUE OF PRESSURE SENSOR 51[#4] | |
| C | ○ | ○ | × | × | USE DETECTED VALUE OF PRESSURE SENSOR 51[#1] | PROHIBIT LIMITING ENGINE POWER |
| | ○ | × | ○ | × | | |
| | ○ | ○ | ○ | × | | |
| | ○ | – | – | △ | | |
| | × | × | ○ | ○ | USE DETECTED VALUE OF PRESSURE SENSOR 51[#4] | |
| | × | ○ | × | ○ | | |
| | × | ○ | ○ | ○ | | |
| | △ | – | – | ○ | | |
| D | △ | – | – | × | USE TARGET FUEL PRESSURE INSTEAD OF FUEL PRESSURE PQ | DEGREE OF LIMITING ENGINE POWER IS "SMALL" |
| | × | – | – | △ | | |
| | △ | – | – | △ | | |

○ NORMAL DETERMINATION
× ABNORMALITY DETERMINATION
△ TEMPORARY ABNORMALITY DETERMINATION

METHOD AND APPARATUS FOR DIAGNOSING A FUEL PRESSURE SENSOR

CROSS-REFERENCE TO RELATED APPLICATIONS

This application is a national phase application of International Application No. PCT/IB2013/000303, filed Mar. 7, 2013, and claims the priority of Japanese Application No. 2012-054803, filed Mar. 12, 2012, the content of both of which is incorporated herein by reference.

BACKGROUND OF THE INVENTION

1. Field of the Invention

The invention relates to a control device and control method for an internal combustion engine, which execute engine operation control on the basis of a fuel pressure detected by a pressure sensor.

2. Description of Related Art

A fuel supply system is connected to an internal combustion engine. The fuel supply system is formed of a supply passage through which high-pressure fuel is supplied, a fuel injection valve connected to the supply passage, and the like. In addition, a pressure sensor for detecting a fuel pressure inside the fuel supply system is assembled to the internal combustion engine. Control associated with fuel injection (injection amount control and injection pressure control) is executed on the basis of an engine operating state including the fuel pressure that is detected by the pressure sensor. By so doing, the amount of fuel that is injected from the fuel injection valve and the fuel pressure inside the fuel supply system (fuel injection pressure) are adjusted on the basis of the engine operating state each time.

If there occurs an abnormality in the pressure sensor, it may lead to a decrease in the accuracy of adjusting the fuel injection amount or the fuel injection pressure. Therefore, there is suggested a device that, at the time of an abnormality of the pressure sensor, executes a process of limiting the power of an internal combustion engine (power limiting process) as fail-safe control for the abnormality (for example, see Japanese Patent Application Publication No. 2008-128307 (JP 2008-128307 A)).

There is also suggested a device, or the like, in which a pressure sensor for detecting a fuel pressure in a fuel supply system is provided cylinder by cylinder in an internal combustion engine. In the device, the fuel pressure detected by each of the pressure sensors is used in injection amount control or injection pressure control.

In the device in which the plurality of pressure sensors are installed in the fuel supply system, if the power limiting process is merely executed when there is an abnormality in any one of the pressure sensors, the power limiting process may be unnecessarily executed. That is, it may enter a situation that the power limiting process is unnecessarily executed although it is possible to accurately execute injection amount control or injection pressure control on the basis of the fuel pressure detected by each normal pressure sensor having no abnormality at this time. Such a situation may lead to an unnecessary decrease in the power characteristic of the internal combustion engine, so it is not desirable.

SUMMARY OF THE INVENTION

The invention provides a control device and control method for an internal combustion engine, which are able to appropriately execute fail-safe control at the time of an abnormality in a pressure sensor.

A first aspect of the invention provides a control device for an internal combustion engine. The control device includes: a plurality of pressure sensors, each of which detects a fuel pressure in a fuel supply system; a first processing unit that executes a first determination process that determines whether, there is an abnormality in the plurality of pressure sensors; a second processing unit connected to two or more pressure sensors which are a part of the plurality of pressure sensors, executes a second determination process that determines whether there is an abnormality in the two or more pressure sensors, and executes a control process associated with fuel injection based on detected values of the two or more pressure sensors; and a controller that is formed of the first processing unit and the second processing unit. The controller is configured to execute a power limiting process for limiting engine power when the number of the pressure sensors determined to be normal in the second determination process is smaller than or equal to one, and, when only one pressure sensor is determined to be normal in the second determination process and when the pressure sensor determined to be normal and one of the pressure sensors connected to only the first processing unit are determined to be normal in the first determination process, the controller is configured to execute the control process on the basis of the detected value of the pressure sensor determined to be normal in the second determination process, and to reduce a degree of limiting engine power through the power limiting process compared with when all the pressure sensors connected to only the first processing unit are determined to be abnormal in the first determination process.

In the above device, in the second determination process made by the second processing unit, the plurality of pressure sensors that detect a fuel pressure in the same fuel supply system are monitored, and, on the condition that two or more of those pressure sensors are determined to be normal, it is determined that the detected values of those pressure sensors determined to be normal are highly reliable values. When the number of pressure sensors determined to be normal in the second determination process is smaller than or equal to one, it is determined that the reliability of the detected value of each pressure sensor is low, and the power limiting process is executed as fail-safe control.

In the above device, when it enters a situation that only one of the pressure sensors connected to the second processing unit is determined to be normal in the second determination process, that is, a situation that it is determined that the reliability of the detected value of each pressure sensor is low through the second determination process, the determination result of the first determination process made by the first processing unit is referenced. When it is confirmed that the pressure sensor determined to be normal in the second determination process and the pressure sensor connected to only the first processing unit between the processing units are determined to be normal in the first determination process, it is determined that the detected value of the pressure sensor determined to be normal in the second determination process is a highly reliable value, and the control process associated with fuel injection based on that detected value is executed. By so doing, the control process is highly accurately executed by the second processing unit.

At this time, because the control process is accurately executed, it may be understood that there is a small request to execute fail-safe control, specifically, a small request to limit engine power. Therefore, in the above device, in comparison with the case where all the pressure sensors connected to only the first processing unit between the processing units are determined to be abnormal in the first determination process, that is, the case where there is a high request to limit engine power, the degree of limiting engine power through the power limiting process is set to a smaller degree. By so doing, an unnecessary reduction in engine power is suppressed, so it is possible to suppress an unnecessary decrease in the power performance of the internal combustion engine.

With the above device, even when it is determined through the second determination process made by the second processing unit that the reliability of the detected value of the pressure sensor is low, but when it is confirmed through the first determination process made by the first processing unit that the reliability of the detected value of that pressure sensor is high, it is possible to execute the control process associated with fuel injection on the basis of that detected value and to suppress the degree of limiting engine power to a lesser degree. Thus, it is possible to appropriately execute fail-safe control at the time of an abnormality in the pressure sensors.

In the control device for an internal combustion engine, the internal combustion engine may include three or more cylinders, and the pressure sensors may be respectively provided for the cylinders of the internal combustion engine one by one, the first processing unit may be connected to all the pressure sensors and may execute a process associated with injection amount control based on the detected values of those pressure sensors, and the second processing unit may be connected to two of the pressure sensors and may execute a process associated with injection pressure control based on the detected values of those pressure sensors as the control process.

In the control device for an internal combustion engine, the controller may reduce the degree of limiting the engine power by prohibiting limiting the engine power through the power limiting process. With the above device, it is possible to favorably suppress an unnecessary decrease in the power performance of the internal combustion engine.

In the control device for an internal combustion engine, the controller may increase the degree of limiting the engine power in the power limiting process when there is no pressure sensor determined to be normal in the second determination process as compared with when only one of the pressure sensors is determined to be normal in the second determination process.

When all the pressure sensors connected to the second processing unit are determined to be abnormal in the second determination process, it is not possible to execute the control process using the detected values of these pressure sensors, in other words, in a manner based on the fuel pressure in the fuel supply system. Therefore, in comparison with the case where any one of the pressure sensors is determined to be normal in the second determination process, this tends to lead to a decrease in the accuracy of executing the control process, and there is a large request to limit engine power. With the above device, because it is possible to increase the degree of limiting engine power in the case where all the two pressure sensors are determined to be abnormal in the second determination process, it is possible to reliably obtain the effect of fail-safe control.

In the control device for an internal combustion engine, when a determination result made in the first determination process does not agree with a determination result made in the second determination process, the controller may determine that there is an abnormality in an electronic control unit that incorporates the first processing unit and the second processing unit.

When there occurs an abnormality in the pressure sensor (specifically, the sensor element or wire), an abnormal signal is input to each of the first processing unit and the second processing unit. So it is determined to be abnormal in both the first determination process and the second determination process that the pressure sensor is abnormal. In this way, the determination results of those determination processes agree with each other. In contrast to this, when there is an abnormality in the electronic control unit that incorporates the first processing unit and the second processing unit, even when substantially the same signal is input from the pressure sensor to each of the first processing unit and the second processing unit, the determination result of the first determination process may not agree with the determination result of the second determination process. With the above device, on the condition that the determination result of the first determination process does not agree with the determination result of the second determination process, it is possible to determine, that there is an abnormality in the electronic control unit.

A second aspect of the invention provides a control method for an internal combustion engine that includes: a plurality of pressure sensors, each of which detects a fuel pressure in a fuel supply system; a first processing unit that is connected to the plurality of pressure sensors and that determines whether there is an abnormality in the plurality of pressure sensors; a second processing unit that is connected to at least two or more pressure sensors, which are part of the plurality of pressure sensors, that executes a control process associated with fuel injection based on detected values of the at least two or more pressure sensors and that determines whether there is an abnormality in the at least two or more pressure sensors. The control method includes: executing a power limiting process for limiting engine power when the number of the pressure sensors determined to be normal is smaller than or equal to one among the at least two or more pressure sensors connected to the second processing unit; and executing the control process on the basis of the detected value of the normal one of the at least two pressure sensors connected to the second processing unit when only one of the at least two or more pressure sensors connected to the second processing unit is normal and one of the pressure sensors connected to only the first processing unit is normal, and reducing a degree of limiting engine power through the power limiting process as compared with when all the pressure sensors connected to only the first processing unit are abnormal.

BRIEF DESCRIPTION OF THE DRAWINGS

Features, advantages, and technical and industrial significance of exemplary embodiments of the invention will be described below with reference to the accompanying drawings, in which like numerals denote like elements, and wherein:

FIG. 7 is a table that shows the relationship among an execution mode, an execution manner of injection pressure control and an execution manner of a power limiting process according to the embodiment.

DETAILED DESCRIPTION OF EMBODIMENTS

Figure 1:
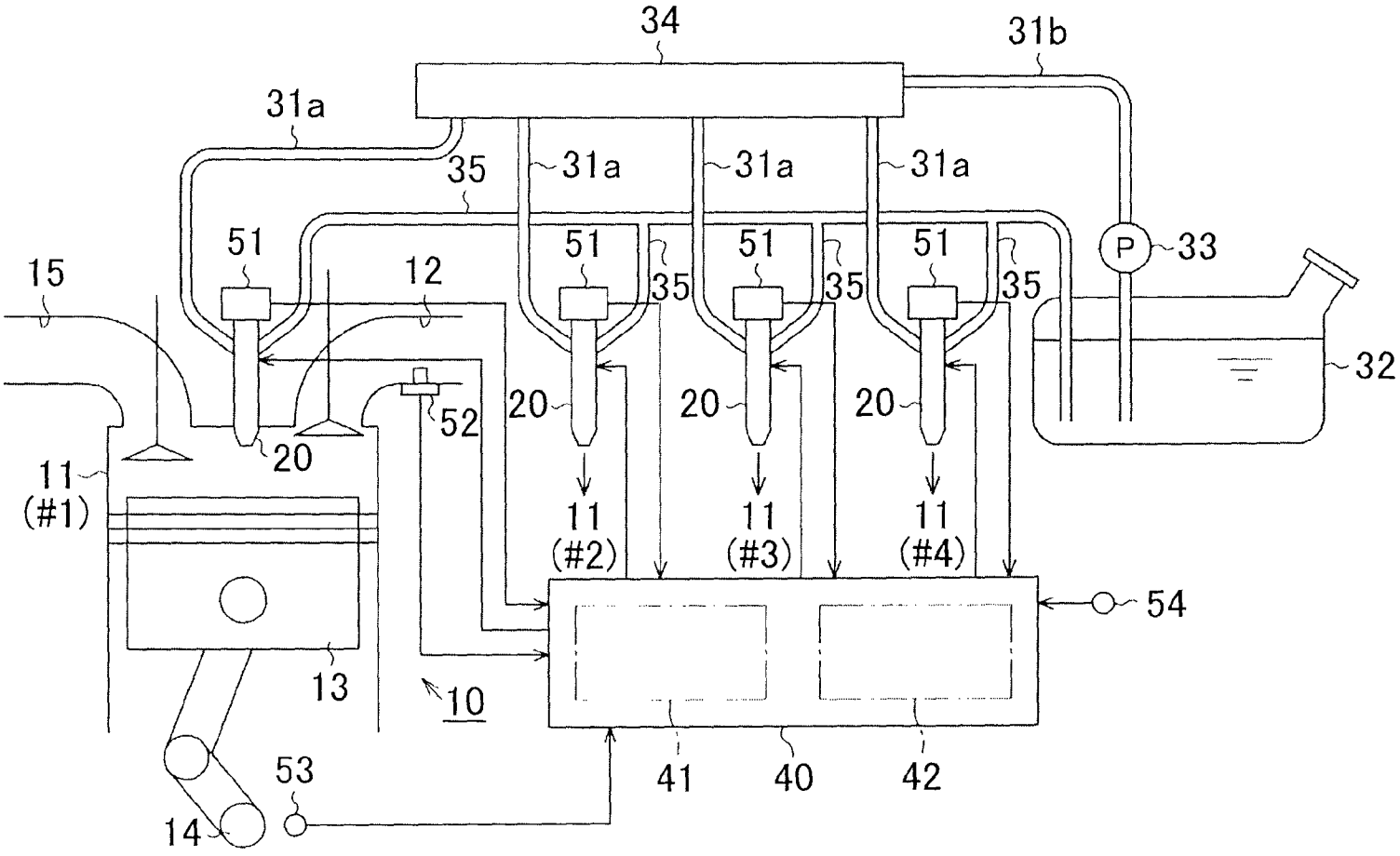
FIG. 1 is a schematic view that shows the schematic configuration of a control device for an internal combustion engine according to an example embodiment of the invention.

Hereinafter, a control device for an internal combustion engine according to an example embodiment of the invention will be described. As shown in FIG. 1, an intake passage 12 is connected to each cylinder 11 of an internal combustion engine 10. Air is taken into each cylinder 11 of the internal combustion engine 10 via the intake passage 12. A diesel engine that includes a plurality of (four [#1 to #4] in the present embodiment) the cylinders 11 is employed as the internal combustion engine 10. A direct injection-type fuel injection valve 20 is assembled to the internal combustion engine 10 in correspondence with each cylinder 11 (#1 to #4). Each fuel injection valve 20 directly injects fuel into the corresponding cylinder 11. Fuel injected through valve opening operation of each fuel injection valve 20 contacts compressed and heated intake air inside the corresponding cylinder 11 of the internal combustion engine 10, and then ignites and combusts. In the internal combustion engine 10, a piston 13 is pushed downward by energy that is generated as a result of combustion of fuel in the corresponding cylinder 11, and a crankshaft 14 that serves as an engine output shaft is forcibly rotated. Combustion gas combusted in each cylinder 11 of the internal combustion engine 10 is emitted to an exhaust passage 15 of the internal combustion engine 10 as exhaust gas.

Each fuel injection valve 20 is connected to a common rail 34 via a corresponding branch passage 31*a*. The common rail 34 is connected to a fuel tank 32 via a supply passage 31*b*. A fuel pump 33 is provided in the supply passage 31*b*. The fuel pump 33 feeds fuel under pressure. In the present embodiment, fuel increased in pressure through pressure feeding of the fuel pump 33 is stored in the common rail 34, and is supplied to the inside of each fuel injection valve 20. A fuel supply system in the present embodiment is formed of the fuel injection valves 20, the branch passages 31*a*, the supply passage 31*b* and the common rail 34.

A return passage 35 is connected to each fuel injection valve 20. Each return passage 35 is connected to the fuel tank 32. Part of fuel inside each fuel injection valve 20 is returned to the fuel tank 32 via the corresponding return passage 35.

Figure 2:
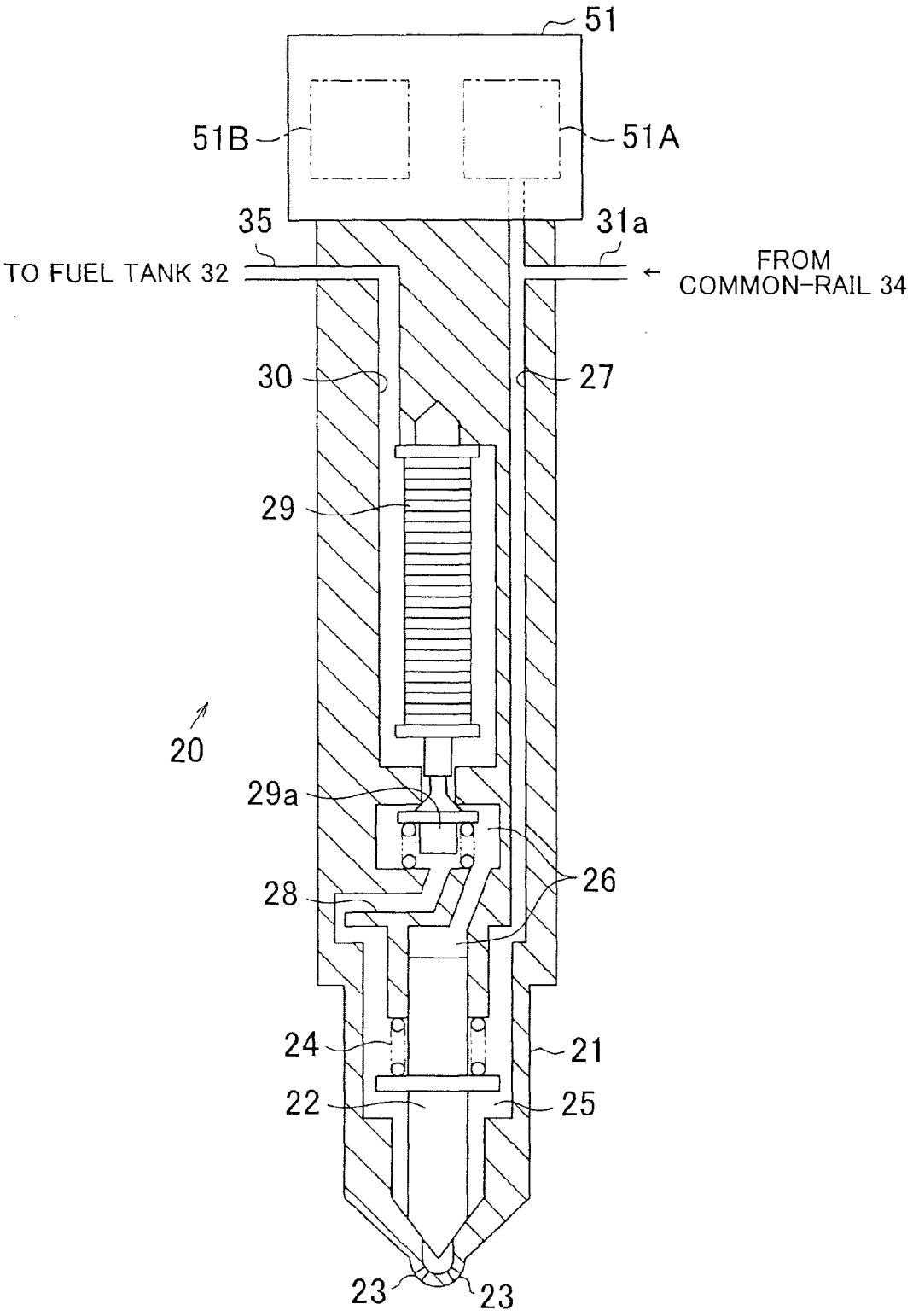
FIG. 2 is a cross-sectional view that shows the cross-sectional structure of a fuel injection valve according to the embodiment.

Hereinafter, the internal structure of each fuel injection valve 20 will be described. As shown in FIG. 2, a needle valve 22 is provided inside a housing 21 of the fuel injection valve 20. The needle valve 22 is provided so as to be able to reciprocally move (move in the vertical direction in the drawing) inside the housing 21. A spring 24 is provided inside the housing 21. The spring 24 constantly urges the needle valve 22 toward injection holes 23 (lower side in the drawing). A nozzle chamber 25 and a pressure chamber 26 are formed inside the housing 21. The nozzle chamber 25 and the pressure chamber 26 are respectively formed on one side (lower side in the drawing) and the other side (upper side in the drawing) of the needle valve 22.

The injection holes 23 communicate the inside of the nozzle chamber 25 with the outside of the housing 21. The nozzle chamber 25 is supplied with fuel from the branch passage 31*a* (common rail 34) via an introducing passage 27. The nozzle chamber 25 and the branch passage 31*a* (common rail 34) are connected to the pressure chamber 26 via a communication passage 28. The pressure chamber 26 is connected to the return passage 35 (fuel tank 32) via a drain passage 30.

An electrically driven type is employed as each fuel injection valve 20. More specifically, a piezoelectric actuator 29 in which piezoelectric elements (for example, piezo elements) that extend or contract in response to an input of a drive signal are laminated is provided inside the housing 21 of the fuel injection valve 20. A valve element 29*a* is connected to the piezoelectric actuator 29. The valve element 29*a* is provided inside the pressure chamber 26. As the valve element 29*a* is moved by actuating the piezoelectric actuator 29, one of the communication passage 28 (nozzle chamber 25) and the drain passage 30 (return passage 35) selectively communicates with the pressure chamber 26.

In the fuel injection valve 20, as a valve closing signal is input to the piezoelectric actuator 29, the piezoelectric actuator 29 contracts to move the valve element 29*a*. Thus, fluid communication between the communication passage 28 and the pressure chamber 26 is allowed, and fluid communication between the return passage 35 and the pressure chamber 26 is interrupted. By so doing, the nozzle chamber 25 and the pressure chamber 26 communicate with each other in a state where fuel inside the pressure chamber 26 is not drained to the return passage 35 (fuel tank 32). As a result, a pressure difference between the nozzle chamber 25 and the pressure chamber 26 becomes extremely small, and the needle valve 22 moves by the urging force of the spring 24 to a position at which the needle valve 22 closes the injection holes 23, so the fuel injection valve 20 at this time enters a state where fuel is not injected (valve closed state).

On the other hand, as a valve opening signal is input to the piezoelectric actuator 29, the piezoelectric actuator 29 extends to move the valve element 29*a*, so fluid communication between the communication passage 28 and the pressure chamber 26 is interrupted, and fluid communication between the return passage 35 and the pressure chamber 26 is allowed. By so doing, part of fuel inside the pressure chamber 26 is returned to the fuel tank 32 via the return passage 35 in a state where fuel does not flow out from the nozzle chamber 25 to the pressure chamber 26. As a result, the pressure of fuel inside the pressure chamber 26 decreases, a pressure difference between the pressure chamber 26 and the nozzle chamber 25 increases, and the needle valve 22 moves against the urging force of the spring 24 due to the pressure difference to move away from the injection holes 23, so the fuel injection valve 20 at this time enters a state where fuel is injected (valve open state).

A pressure sensor 51 is integrally connected to the fuel injection valve 20. The pressure sensor 51 is used to detect a fuel pressure PQ inside the introducing passage 27. Therefore, for example, in comparison with a device in which a fuel pressure at a location remote from the fuel injection valve 20, such as a fuel pressure inside the common rail 34 (see FIG. 1), is detected, it is possible to detect a fuel pressure at a location near the injection holes 23 of the fuel injection valve 20. So it is possible to accurately detect a variation in fuel pressure inside the fuel injection valve 20 as a result of opening and closing of the fuel injection valve 20. The pressure sensor 51 is formed of a sensor element 51A that outputs a signal corresponding to a fuel pressure and a memory 51B that stores a detected value of the sensor element 51A, and is provided one by one for each fuel injection valve 20, that is, each cylinder 11 of the internal combustion engine 10. Hereinafter, when it is required to indicate the cylinder 11 in which the pressure sensor 51 is arranged, the pressure sensor 51 provided in the cylinder 11[#1] is referred to as the pressure sensor 51[#1], the pressure sensor 51 provided in the cylinder 11 [#2] is referred to as the pressure sensor 51[#2], the pressure sensor 51 provided in the cylinder 11 [#3] is referred to as the pressure sensor 51[#3], and the pressure sensor 51 provided in the cylinder 11 [#4] is referred to as the pressure sensor 51[#4].

As shown in FIG. 1, various sensors for detecting an operating state are provided for the internal combustion engine 10 as peripheral devices of the internal combustion engine 10. Those sensors, for example, include an intake air flow rate sensor 52 for detecting the amount of air that passes through the intake passage 12 (passage air flow rate GA) and a crank sensor 53 for detecting the rotation speed of the crankshaft 14 (engine rotation speed NE) in addition to the pressure sensors 51. Other than those, for example, an accelerator sensor 54 for detecting the operation amount of an accelerator operation member (for example, accelerator pedal) (accelerator operation amount ACC) is provided.

The peripheral devices of the internal combustion engine 10, for example, include an electronic control unit 40 that is formed of processing units. The electronic control unit 40 acquires output signals of the various sensors, computes various computations on the basis of those output signals. The electronic control unit 40 executes various controls associated with the operation of the internal combustion engine 10, such as operation control over the fuel injection valves 20 (injection amount control) and operation control over the fuel pump 33 (injection pressure control), on the basis of the computed results. The electronic control unit 40 includes two processing units, that is, a first processing unit 41 and a second processing unit 42. The functions of these first processing unit 41 and second processing unit 42 will be described in detail later.

In the present embodiment, injection amount control is executed as follows. First, on the basis of the engine operating state, such as the passage air flow rate GA, the engine rotation speed NE and the accelerator operation amount ACC, an injection pattern is selected and various control target values for each injection of the injection pattern are calculated. In the present embodiment, a plurality of injection patterns, each of which combines main injection, pre-injection, after-injection, and the like, are set in advance, and one of those injection patterns is selected at the time of executing injection amount control. As for the various control target values, a target value of a fuel injection amount (target injection amount) of each injection, such as main injection, pre-injection and after-injection, a target value of injection timing (target injection timing) of main injection, an interval between main injection and pre-injection (pilot interval) and an interval between main injection and after-injection (after interval) are calculated. In the present embodiment, the relationship between the above-described engine operating state and control target values suitable for the operating state and the relationship between the above-described engine operating state and an injection pattern suitable for the operating state are obtained in advance on the basis of results of an experiment or simulation, and each are stored in the second processing unit 42 of the electronic control unit 40. The second processing unit 42 individually sets various control target values and the injection pattern from the above-described relationships on the basis of the engine operating state each time.

Then, a control target value for the opening period of each fuel injection valve 20 (target injection period TAU) is set from a model formula on the basis of the above target injection amount and the fuel pressure PQ. In the present embodiment, a physics model that models the fuel supply system formed of the common rail 34, the branch passages 31*a*, the fuel injection valves 20, and the like, is constructed, and the above target injection period TAU is calculated through the physics model. More specifically, the model formula that uses the target injection amount, the fuel pressure PQ, learning correction terms (described later), and the like, as variables is set and prestored in the second processing unit 42, and the target injection period TAU is calculated through the model formula.

A drive signal is output from the electronic control unit 40 on the basis of the target injection timing and the target injection period TAU, and each fuel injection valve 20 is individually actuated to open on the basis of the input drive signal. By so doing, fuel of an amount appropriate for an engine operating state each time in an injection pattern suitable for the engine operating state is injected from each fuel injection valve 20, and is supplied into the corresponding cylinder 11 of the internal combustion engine 10, so rotational torque appropriate for the engine operating state is applied to the crankshaft 14.

In the present embodiment, a process of learning the target injection period TAU of each injection (pre-injection, main injection, after-injection) (learning process) is executed on the basis of the fuel pressure PQ that is detected by each pressure sensor 51.

In this learning process, first, a basic temporal waveform of a fuel injection rate is calculated on the basis of various calculation parameters, such as a target injection amount, target injection timing and a fuel pressure PQ. In the present embodiment, the relationship between an engine operating region that is determined from those calculation parameters and a basic temporal waveform suitable for the operating region is obtained in advance on the basis of results of an experiment or simulation, and is stored in the first processing unit 41 of the electronic control unit 40. The first processing unit 41 calculates a basic temporal waveform from the above relationship on the basis of various calculation parameters.

Figure 3:
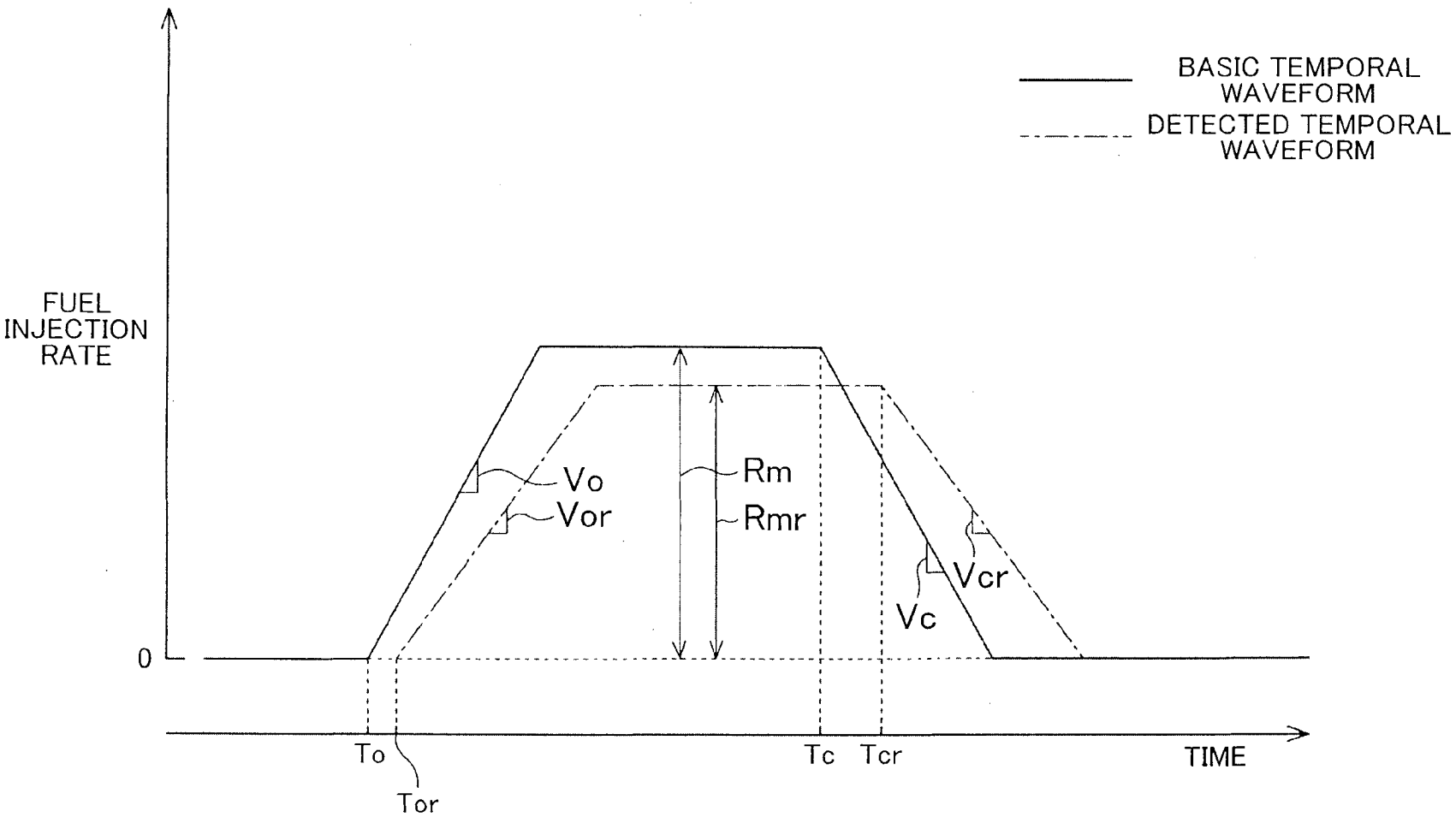
FIG. 3 is a time chart that shows an example of a basic temporal waveform according to the embodiment.

FIG. 3 shows an example of the basic temporal waveform. As indicated by the solid line in FIG. 3, the basic temporal waveform is set to a trapezoidal waveform that is defined by timing at which each fuel injection valve 20 starts opening (valve opening operation start timing To), a rate of increase in fuel injection rate after the fuel injection valve 20 starts opening (rate of increase in injection rate Vo), timing at which the fuel injection valve 20 starts closing (valve closing operation start timing Tc), a rate of decrease Vc in fuel injection rate after the fuel injection valve 20 starts closing, and a maximum value of the fuel injection rate (maximum fuel injection rate Rm).

On the other hand, a temporal waveform of an actual fuel injection rate (detected temporal waveform) is formed on the basis of the fuel pressure PQ that is detected with the use of the corresponding pressure sensor 51. Specifically, first, on the basis of changes of the fuel pressure PQ, the actual valve opening operation start timing Tor, actual rate of increase in injection rate Vor, actual valve closing operation start timing Tcr, actual rate of decrease in injection rate Vcr and actual maximum injection rate Rmr of the corresponding fuel injection valve 20 are identified. The fuel pressure inside each fuel injection valve 20 (specifically, the nozzle chamber 25) decreases with an increase in lift amount as the fuel injection valve 20 is opened, and, after that, increases with a reduction in lift amount as the fuel injection valve 20 is closed. In the present embodiment, on the basis of changes of the fuel pressure (specifically, the fuel pressure PQ) inside each fuel injection valve 20, the above-described actual valve opening operation start timing Tor, actual rate of increase in injection rate Vor, actual valve closing operation start timing Tcr, actual rate of decrease in injection rate Vcr and actual maximum injection rate Rmr are accurately identified. As indicated by the alternate long and short dash line in FIG. 3, the temporal waveform of an actual fuel injection rate (detected temporal waveform) is formed by those identified values.

In the learning process, during operation of the internal combustion engine 10, the above-described detected temporal waveform and the basic temporal waveform are compared with each other, and a difference in each parameter between these waveforms is sequentially calculated. Specifically, a difference ΔTog (=To−Tor) in valve opening operation start timing, a difference ΔVog (=Vo−Vor) in rate of increase in injection rate, a difference ΔTcg (=Tc−Tcr) in valve closing operation start timing, a difference ΔVcg (=Vc−Vcr) in rate of decrease in injection rate and a difference ΔRmg (=Rm−Rmr) in maximum injection rate are calculated as the differences of the parameters. These differences ΔTog, ΔVog, ΔTcg, ΔVcg and ΔRmg are stored in the first processing unit 41 as the learning correction terms for compensating for a variation in operation characteristic due to aged degradation of each fuel injection valve 20.

In the present embodiment, these, learning correction terms (ΔTog, ΔVog, ΔTcg, ΔVcg, ΔRmg) each are used as the calculation parameter for calculating the target injection period TAU on the basis of the above-described model formula. By calculating the target injection period TAU in this way, the influence of the operation characteristic variation due to aged degradation of each fuel injection valve 20 is compensated. The process of calculating the learning correction terms on the basis of the fuel pressure PQ is executed for each of the cylinders 11 (#1 to #4) of the internal combustion engine 10 on the basis of the output signal of the corresponding pressure sensor 51.

In the present embodiment, injection pressure control is executed as follows. First, a control target value for the fuel pressure in the common rail 34 (target fuel pressure) is calculated on the basis of the passage air flow rate GA and the engine rotation speed NE, and the operation amount of the fuel pump 33 (the amount of fuel fed under pressure or the amount of fuel returned) is adjusted such that an actual fuel pressure becomes the target fuel pressure. Through such adjustment of the operation amount of the fuel pump 33, the fuel pressure inside the common rail 34, in other words, the fuel injection pressure of each fuel injection valve 20, is adjusted to the pressure based on the engine operating state.

Figure 4:
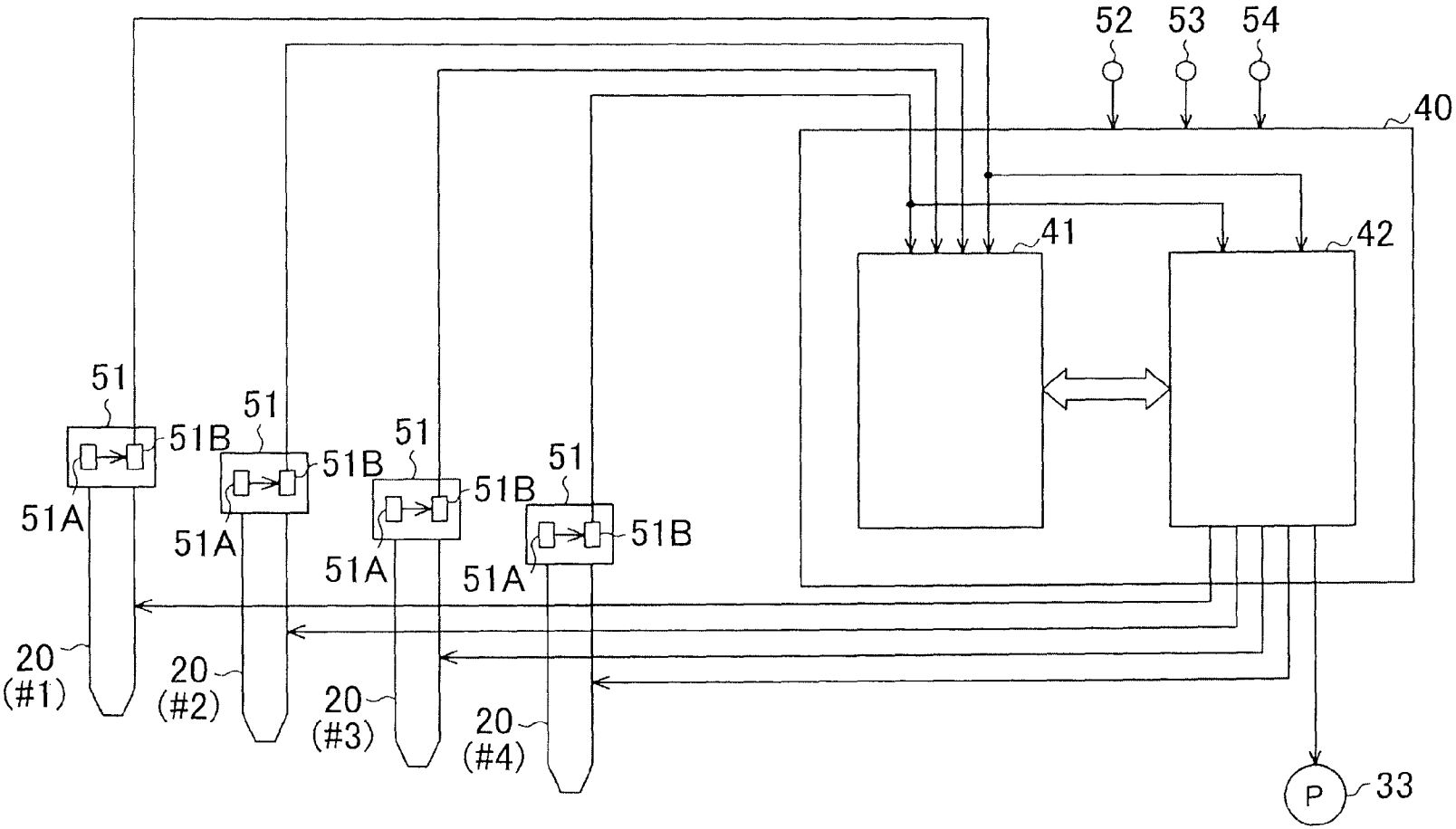
FIG. 4 is a schematic view that shows a manner in which an electronic control unit according to the embodiment is connected to each fuel injection valve.

As shown in FIG. 4, all the pressure sensors 51[#1], 51[#2], 51[#3], 51[#4] respectively provided for the cylinders 11 of the internal combustion engine 10 are connected to the first processing unit 41. The first processing unit 41 executes the above-described learning process as a computing process associated with injection amount control. The first processing unit 41 executes a first determination process for determining whether there is an abnormality in the pressure sensors 51[#1] to 51[#4] connected to the first processing unit 41. In this first determination process, it is determined individually for each of the pressure sensors 51[#1] to 51[#4] whether the following condition is satisfied. Condition: The detected value of the corresponding pressure sensor 51 is not an abnormal value. Specifically, the detected value of the corresponding pressure sensor 51 falls within a predetermined range.

It is determined that the determination target pressure sensor 51 is normal when the above condition is satisfied; whereas it is determined that the determination target pressure sensor 51 is abnormal when the above condition is not satisfied. In this first determination process, more specifically, once the above condition is not satisfied, temporary abnormality determination is initially made, and, after that, when a state where the above condition is not satisfied has continued for a predetermined period of time (for example, several seconds), abnormality determination is finally determined.

When it is determined that any one of the pressure sensors 51 is abnormal, the first processing unit 41 stops executing the learning process based on the detected value of the pressure sensor 51 that is determined to be abnormal. The learning process in which the detected value of the pressure sensor 51 that is determined to be abnormal is not used, that is, the learning process that is executed on the basis of only the detected values of the pressure sensors 51 that are determined to be normal is continuously executed.

Two (specifically, the pressure sensors 51[#1] and 51[#4]) of the pressure sensors 51 respectively provided for the cylinders 11 of the internal combustion engine 10 are connected to the second processing unit 42. As indicated by the outlined arrow in FIG. 4, in the device according to the present embodiment, the first processing unit 41 and second processing unit 42 of the electronic control unit 40 are connected by a signal line, and data transmission between those first processing unit 41 and second processing unit 42 is allowed.

The second processing unit 42 executes a process of loading the learning correction terms from the first processing unit 41 at the time of calculating the target injection period TAU or a process of calculating the target injection period TAU from the model formula on the basis of the learning correction terms and the engine operating state.

The second processing unit 42 executes a process associated with injection pressure control, such as a process of calculating a target fuel pressure on the basis of the engine operating state and a process of adjusting the operation amount of the fuel pump 33 so as to bring the target fuel pressure into coincidence with an actual fuel pressure PQ. Specifically, the actual fuel pressure PQ is a higher one of the fuel pressures PQ that are respectively detected by the two pressure sensors 51[#1] and 51[#4] connected to the second processing unit 42. In the present embodiment, the process associated with injection pressure control functions as a control process associated with fuel injection.

The second processing unit 42 executes a second determination process for determining whether there is an abnormality in the two pressure sensors 51[#1] and 51[#4] connected to the second processing unit 42. In this second determination process, it is determined individually for each of the two pressure sensors 51[#1] and 51[#4] whether the above-described condition is satisfied. It is determined that the determination target pressure sensor 51 is normal when the condition is satisfied; whereas it is determined that the determination target pressure sensor 51 is abnormal when the condition is not satisfied.

The second processing unit 42 executes a power limiting process of limiting engine power when at least one of the two pressure sensors 51[#1] and 51[#4] is determined to be abnormal. In the present embodiment, in the second determination process, the detected values of the two pressure sensors 51[#1] and 51[#4] that detect the fuel pressure inside the same fuel supply system are monitored, and, on the condition that both the pressure sensors 51[#1] and 51[#4] are determined to be normal, it is determined that the detected values of the pressure sensors 51[#1] and 51[#4] are highly reliable values. When the number of the pressure sensors 51 that are determined to be normal through the second determination process becomes 1 or 0, it is understood that the reliability of the detected value of each pressure sensor 51 is low, and the power limiting process is executed as fail-safe control. This power limiting process is specifically executed such that a fuel injection amount (specifically, a target fuel injection amount) is suppressed to a small amount by setting an upper limit for the accelerator operation amount ACC that is used to calculate the target injection amount in injection amount control to thereby limit engine power.

In the device, according to the present embodiment, the four pressure sensors 51[#1] to 51[#4] are installed in the fuel supply system. Therefore, in the second determination process made by the second processing unit 42, if the power limiting process is executed when there is an abnormality in only one of the two pressure sensors 51[#1] and 51[#4] that are connected to the second processing unit 42, the power limiting process may be unnecessarily executed. That is, it may enter a situation that the power limiting process is unnecessarily executed although it is possible to accurately execute injection amount control or injection pressure control on the basis of the fuel pressure PQ detected with the use of the normal pressure sensor 51 that has no abnormality at this time. Such a situation may lead to an unnecessary decrease in the power characteristic of the internal combustion engine 10, so it is not desirable.

In the present embodiment, when it enters a situation that only one of the pressure sensors 51[#1] and 51[#4] connected to the second processing unit 42 is determined to be normal in the second determination process, that is, it is determined through the second determination process that the reliability of the detected value of each pressure sensor 51 is low, the determination result of the first determination process in the first processing unit 41 is loaded to the second processing unit 42 and is referenced. When the determination result of the first determination process indicates that the pressure sensor 51 determined to be normal in the second determination process and one of the other pressure sensors 51 (specifically, the pressure sensors 51[#2] and 51[#3] connected to only the first processing unit 41) are determined to be normal, it is determined that the reliability of the detected value of the pressure sensor 51 determined to be normal in the second determination process is high. In this case, the process associated with injection pressure control is executed by the second processing unit 42 on the basis of the detected value of the pressure sensor 51 determined to be normal in the second determination process. By so doing, injection pressure control is executed with high accuracy.

At this time, because injection pressure control is accurately executed, it may be understood that there is a small request to execute fail-safe control, specifically, a small request to limit engine power. In the device according to the present embodiment, at this time, limiting engine power through the power limiting process is prohibited, and the power limiting process is not executed. Therefore, an unnecessary reduction in engine power is suppressed, and an unnecessary decrease in the power performance of the internal combustion engine 10 is suppressed.

According to the present embodiment, even when it is determined through the second determination process that the reliability of the detected value of the pressure sensor 51 is low, but when it is confirmed through the first determination process that the reliability of the detected value of that pressure sensor 51 is high, it is possible to execute injection pressure control on the basis of the detected value of that pressure sensor 51 and to suppress the degree of limiting engine power through the power limiting process to a lesser degree.

In a situation that only one of the pressure sensors 51 is determined to be normal through the second determination process, when the determination result of the first determination process indicates that both the two pressure sensors 51[#2] and 51[#3] connected to only the first processing unit 41 are determined to be abnormal, injection pressure control or power limiting process is executed as follows.

At this time, it is determined that the reliability of the pressure sensor 51 determined to be normal in the second determination process is low, but injection pressure control based on that detected value is executed by the second processing unit 42. However, in synchronization with execution of such injection pressure control, engine power is limited through the power limiting process. By so doing, in comparison with the case where any one of the two pressure sensors 51[#2] and 51[#3] connected to only the first processing unit 41 between the processing units 41 and 42 is determined to be normal, that is, the case where a request to limit engine power is low, it is possible to increase the degree of limiting engine power through the power limiting process.

In addition, in the device according to the present embodiment, when there is no pressure sensor 51 that is determined to be normal in the second determination process executed by the second processing unit 42, in comparison with the case where only one pressure sensor 51 is determined to be normal in the second determination process, the degree of limiting engine power in the power limiting process is increased. When both the pressure sensors 51[#1] and 51[#4] connected to the second processing unit 42 are determined to be abnormal in the second determination process, it is not possible to execute injection pressure control using the detected values of these pressure sensors 51[#1] and 51[#4], in other words, in a manner based on the fuel pressure in the fuel supply system. Therefore, in comparison with the case where any one of the pressure sensors 51 is determined to be normal in the second determination process, this situation tends to lead to a decrease in the accuracy of executing injection pressure control, and there is a large request to limit engine power. With the device according to the present embodiment, because it is possible to increase the degree of limiting engine power in the case where both the two pressure sensors 51[#1] and 51[#4] are determined to be abnormal in the second determination process, it is possible to reliably obtain the effect of fail-safe control.

In this way, with the device according to the present embodiment, it is possible to appropriately execute fail-safe control at the time of an abnormality in the pressure sensors 51. In addition, in the device according to the present embodiment, when the determination result of the first determination process made by the first processing unit 41 does not agree with the determination result of the second determination process made by the second processing unit 42, it is determined that the electronic control unit 40 that incorporates the first processing unit 41 and the second processing unit 42 is abnormal.

When there occurs an abnormality in the pressure sensors 51[#1] and 51[#4] (specifically, the sensor elements 51A, the memories 51B or wires) connected to both the first processing unit 41 and the second processing unit 42, an abnormal signal is input to each of the units 41 and 42, so it is determined to be abnormal in the first determination process and the second determination process. That is, in this case, the determination result of the first determination process agrees with the determination result of the second determination process. In contrast to this, even when substantially the same signal is input from each of the pressure sensors 51[#1] and 51[#4] to each of the processing units 41 and 42, if there is an abnormality in the electronic control unit 40, for example, only one of those processing units 41 and 42 does not function normally, the determination result of the first determination process may not agree with the determination result of the second determination process. According to the present embodiment, it is possible to determine that there is an abnormality in the electronic control unit 40 on the condition that the determination result of the first determination process does not agree with the determination result of the second determination process.

Figure 5:
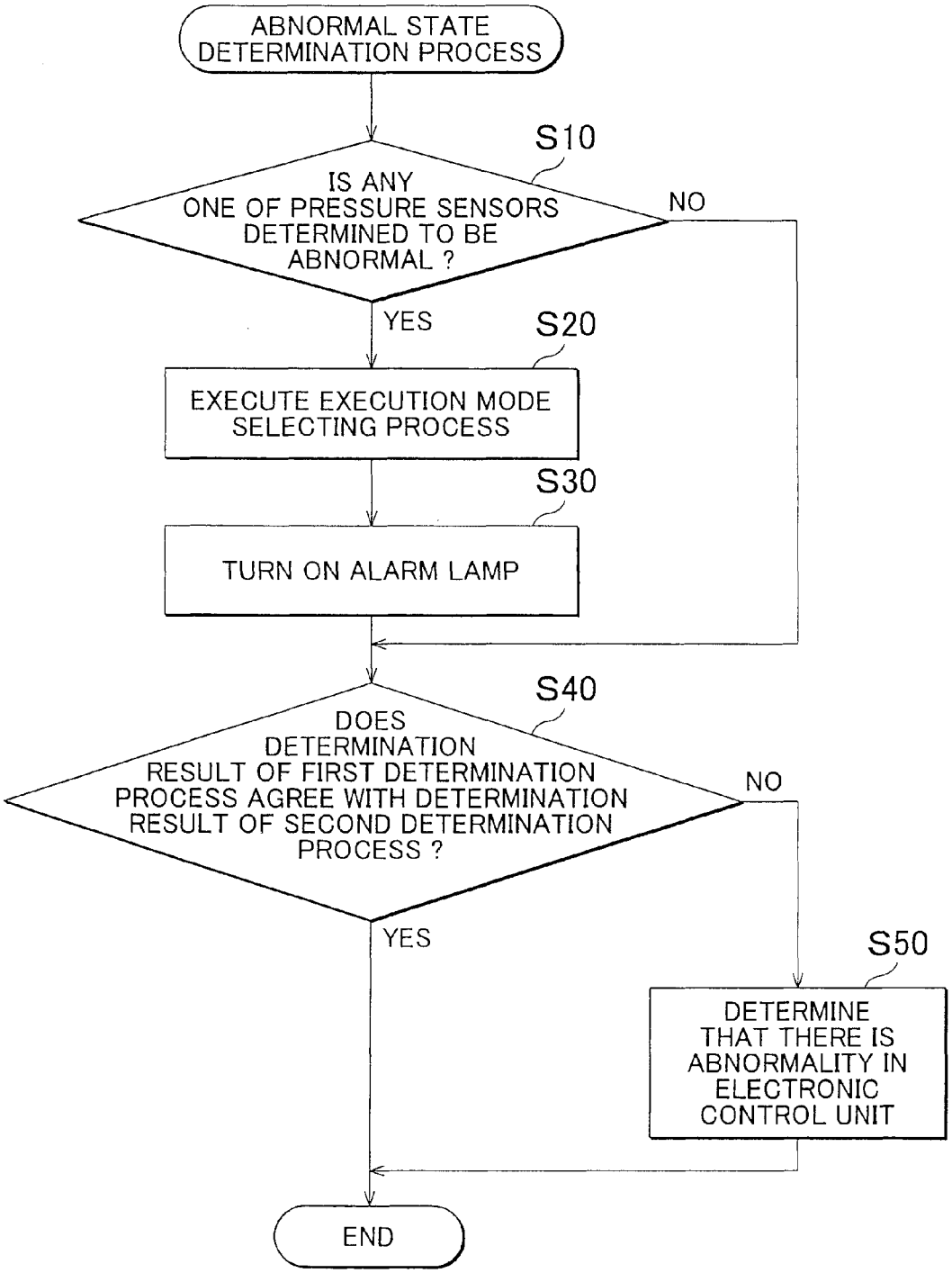
FIG. 5 is a flowchart that shows the procedure of executing an abnormal state determination process according to the embodiment.

Hereinafter, a manner of limiting engine power through the power limiting process will be described in detail. FIG. 5 shows the procedure of executing a process of determining whether there is an abnormality in the pressure sensors 51[#1] to 51[#4] (abnormal state determination process). A series of processes shown in the flowchart of the drawing conceptually shows the procedure of executing the abnormal state determination process. An actual process is executed by the first processing unit 41 as an interrupt process at predetermined intervals.

As shown in FIG. 5, in this process, first, it is determined whether any one of the four pressure sensors 51[#1] to 51[#4] connected to the first processing unit 41 is determined to be abnormal (step S10). When any one of those pressure sensors 51[#1] to 51[#4] is determined to be abnormal (YES in step S10), the process of selecting an execution mode of the power limiting process (execution mode selecting process) is executed (step S20).

Figure 6:
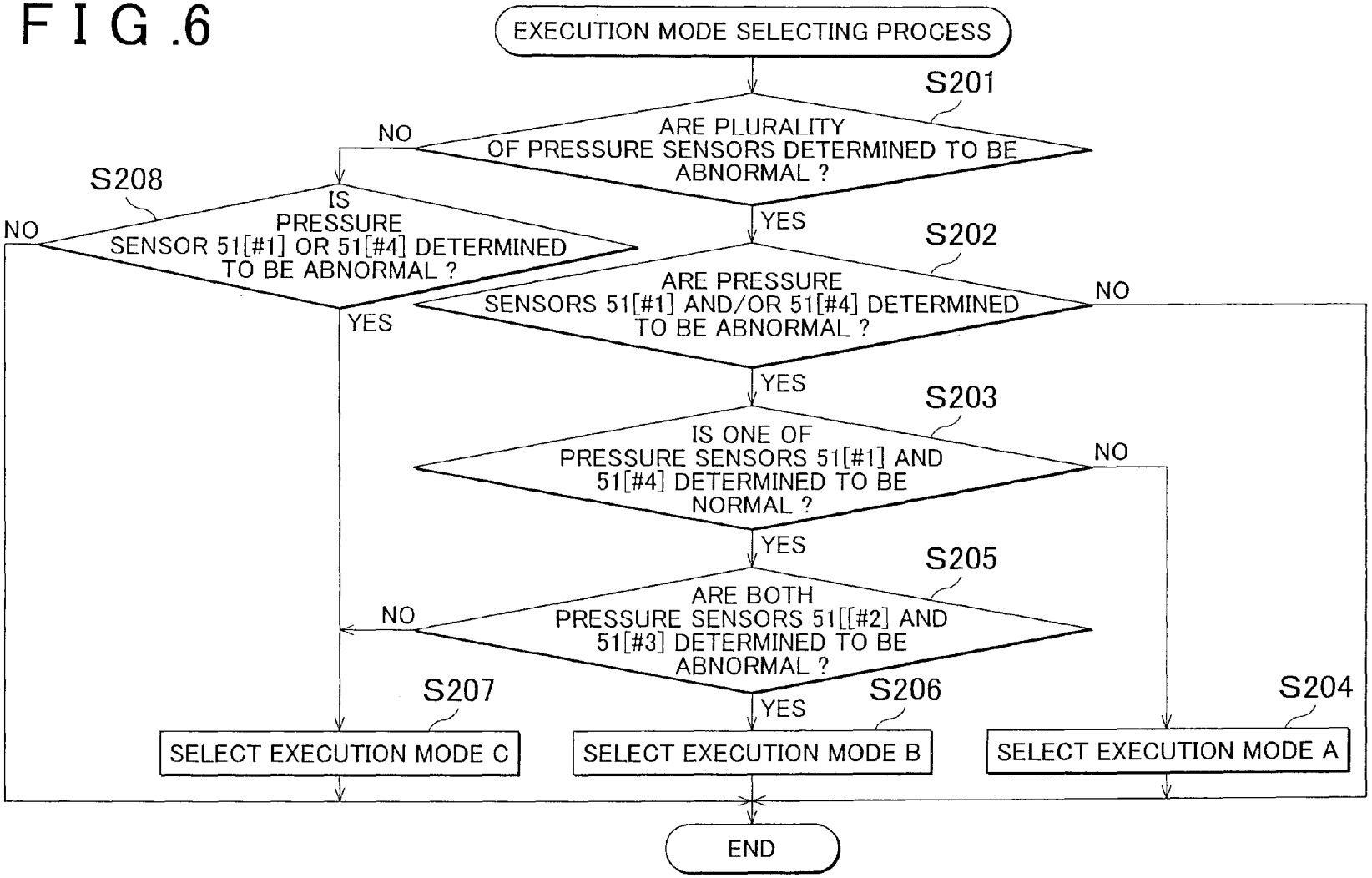
FIG. 6 is a flowchart that shows the procedure of an execution mode selecting process according to the embodiment.

FIG. 6 shows the procedure of executing the execution mode selecting process. FIG. 7 shows the relationship among an execution mode, a manner of executing injection pressure control and a manner of executing power limiting process. As shown in FIG. 6, in the execution mode selecting process, when both the pressure sensors 51[#1] and 51[#4] are determined to be abnormal (YES in step S201, YES in step S202 and NO in step S203), the execution mode A is selected (step S204).

In this case, in response to the fact that the execution mode A is selected in the first determination process of the first processing unit 41, the second processing unit 42 executes injection amount control and injection pressure control as follows.

That is, as shown in FIG. 7, when the execution mode A is selected in the first processing unit 41, a predetermined operation amount LIML (for example, 10% in the case where an operation amount for fully opening an accelerator is 100%) is set in the power limiting process as the upper limit of the accelerator operation amount ACC. Then, injection amount control is executed on the basis of the accelerator operation amount ACC limited by the upper limit.

Injection pressure control is executed on the assumption that a target fuel pressure coincides with an actual fuel pressure without using the fuel pressures that are respectively detected with the use of the pressure sensors 51[#1] and 51[#4]. Specifically, the target fuel pressure is used instead of the fuel pressure PQ in a situation that the fuel pump 33 is controlled to be driven in order to bring the target injection pressure into coincidence with the fuel pressure PQ in the case where the pressure sensors 51[#1] and 51[#4] are not determined to be abnormal.

When only one of the pressure sensors 51[#1] and 51[#4] is determined to be abnormal (all the step S201 to step S203 in FIG. 6 are "YES") and when both the pressure sensors 51[#2] and 51[#3] are determined to be abnormal (YES in step S205), the execution mode B is selected (step S206).

In a situation that only one of the pressure sensors 51[#1] and 51[#4] is determined to be abnormal in the second determination process made by the second processing unit 42, when the execution mode B is selected in the first processing unit 41, a predetermined operation amount LIMS (where LIMS>LIML) is set by the power limiting process as the upper limit of the accelerator operation amount ACC as shown in FIG. 7. Specifically, the predetermined operation amount LIMS is set to a large operation amount (for example, 70% in the case where an operation amount for fully opening the accelerator is 100%) at the time of abnormality determination, and is set to a value that gradually reduces to a relatively small operation amount (for example, 25%) with a lapse of a predetermined period of time (for example, several minutes) thereafter. Injection amount control is executed on the basis of the accelerator operation amount ACC limited by the upper limit. Injection pressure control is executed on the basis of the fuel pressure PQ that is detected with the use of the normal one of the pressure sensors 51[#1] and 51[#4].

When only one of the pressure sensors 51[#1] and 51[#4] is determined to be abnormal (all the step S201 to step S203 in FIG. 6 are "YES") and when at least one of the pressure sensors 51[#2] and 51[#3] is determined to be normal (NO in step S205), the execution mode C is selected (step S207). When only the pressure sensor 51[#1] among the four pressure sensors connected to the first processing unit 41 is determined to be abnormal or when only the pressure sensor 51[#4] is determined to be abnormal as well (NO in step S201, YES in step S208), the execution mode C is selected (step S207).

In a situation that only one of the pressure sensors 51[#1] and 51[#4] in the second determination process made by the second processing unit 42 is determined to be abnormal, when the execution mode C is selected in the first processing unit 41, limiting engine power through the power limiting process is prohibited and the power limiting process is not executed as shown in FIG. 7. Specifically, injection amount control is executed without limiting the accelerator operation amount ACC to the upper limit. Injection pressure control is executed on the basis of the fuel pressure PQ that is detected with the use of the normal one of the pressure sensors 51[#1] and 51[#4].

When, among the four pressure sensors connected to the first processing unit 41, both the pressure sensors 51[#1] and 51[#4] are not determined to be abnormal and only the pressure sensor 51[#2] or only the pressure sensor 51[#3] is determined to be abnormal (NO in step S201 and NO in step S208), none of the execution modes A to C is selected (the process of step S207 is skipped). When, among the four pressure sensors connected to the first processing unit 41, both the pressure sensors 51[#1] and 51[#4] are not determined to be abnormal and only the two pressure sensors 51[#2] and 51[#3] are determined to be abnormal as well (YES in step S201 and NO in step S202), none of the execution modes A to C is selected (the processes of step S203 to step S206 are skipped). In this case, injection pressure control based on the pressure sensors 51[#1] and 51[#4] and injection amount control in a manner in which the accelerator operation amount ACC is not limited by the upper limit are executed.

In the device according to the present embodiment, as shown in FIG. 7, when only one of the pressure sensors 51[#1] and 51[#4] is determined to be normal, and when the other one is temporarily determined to be abnormal, the execution mode C is selected not on the basis of the determination results as to the pressure sensors 51[#2] and 51[#3]. In this case, it is an instable period during which, depending on whether the temporary abnormality determination is final abnormal determination or final normal determination, both the pressure sensors 51[#1] and 51[#4] are determined to be normal or only one of the pressure sensors 51[#1] and 51[#4] is determined to be normal, so the execution mode C is selected as a temporary execution mode of the power limiting process. In this case, limiting engine power through the power limiting process is prohibited and the power limiting process is not executed, while injection pressure control is executed on the basis of the fuel pressure PQ that is detected with the use of the normal one of the pressure sensors 51[#1] and 51[#4].

In addition, in the device according to the present embodiment, when one of the pressure sensors 51[#1] and 51[#4] is determined to be abnormal and the other one is temporarily determined to be abnormal or when both the pressure sensors 51[#1] and 51[#4] are temporarily determined to be abnormal, the execution mode D is selected as the execution mode of the power limiting process not on the basis of the determination results as to the pressure sensors 51[#2] and 51[#3]. In this case, the predetermined operation amount LIMS is set by the power limiting process as the upper limit of the accelerator operation amount ACC. Injection amount control is executed on the basis of the accelerator operation amount ACC limited by the upper limit. Injection pressure control is executed on the assumption that a target fuel pressure coincides with an actual fuel pressure without using the fuel pressures that are respectively detected with the use of the pressure sensors 51[#1] and 51[#4].

Then, in the abnormal state determination process (FIG. 5), after the execution mode selecting process is executed (step S20), an alarm lamp provided in a vehicle cabin is turned on (step S30). When all the four pressure sensors 51[#1] to 51[#4] connected to the first processing unit 41 are determined to be normal (NO in step S10), the processes of step S20 and step S30 are skipped.

After that, the determination result of the second determination process made by the second processing unit 42 is loaded, and it is determined whether the loaded determination result agrees with the determination result of the first determination process made by the first processing unit 41 (step S40). When those determination results agree with each other (YES in step S40), the process once directly ends (the process of step S50 is skipped). On the other hand, when those determination results do not agree with each other (NO in step S40), after it is determined that there is an abnormality in the electronic control unit 40 (step S50), the process once ends.

As described above, according to the present embodiment, the following advantageous effects are obtained. When only one of the pressure sensors 51[#1] and 51[#4] is determined to be normal in the second determination process, and when the determination result of the first determination process indicates that the pressure sensor 51 determined to be normal in the second determination process and one of the pressure sensors 51[#2] and 51[#3] connected to only the first processing unit 41 are determined to be normal, injection pressure control based on the detected value of the pressure sensor 51 determined to be normal in the second determination process is executed. In addition, limiting engine power through the power limiting process is prohibited at this time. Therefore, even when it is determined through the second determination process that the reliability of the detected value of the pressure sensor 51 is low, but when it is confirmed through the first determination process that the reliability of the detected value of that pressure sensor 51 is high, it is possible to execute injection pressure control on the basis of the detected value of that pressure sensor 51 and to suppress the degree of limiting engine power through the power limiting process to a lesser degree. Thus, it is possible to appropriately execute fail-safe control at the time of an abnormality in the pressure sensors 51.

When there is no pressure sensor 51 that is determined to be normal in the second determination process executed by the second processing unit 42, in comparison with the case where only one pressure sensor 51 is determined to be normal in the second determination process, the degree of limiting engine power in the power limiting process is increased. Therefore, it is possible to reliably obtain the effect of fail-safe control.

On the condition that the determination result of the first determination process made by the first processing unit 41 does not agree with the determination result of the second determination process made by the second processing unit 42, it is determined that the electronic control unit 40 that incorporates the first processing unit 41 and the second processing unit 42 is abnormal.

The above-described embodiment may be modified as follows. When any one of the pressure sensors 51 is determined to be abnormal in the first determination process made by the first processing unit 41, instead of turning on the alarm lamp, details for alarming occurrence of the abnormality may be indicated by an image display device provided in the vehicle cabin, and a history of abnormality determination may be recorded in the electronic control unit 40.

In the first determination process made by the first processing unit 41, the process of turning on the alarm lamp when any one of the pressure sensors 51 is determined to be abnormal (the process of step S30 in FIG. 5) may be omitted.

The condition for determining whether there is an abnormality in the pressure sensors 51 is not limited to the above-described condition. The condition may be arbitrarily changed to, for example, a condition that a state where a difference between a target fuel pressure and the fuel pressure PQ is larger than a predetermined value has continued for a predetermined period.

In the above-described embodiment, the upper limit value of the accelerator operation amount ACC is set in order to limit engine power; instead, a method of limiting engine power may be arbitrarily changed, for example, a value obtained by correcting and reducing the accelerator operation amount ACC may be used in injection amount control, the fuel injection amount may be corrected and reduced or an upper limit may be set for the fuel injection amount.

The process of determining whether there is an abnormality in the electronic control unit 40 (the processes of step S40 and step S50 in FIG. 5) may be omitted. When the execution mode C is selected in the first processing unit 41 in a situation that only one of the pressure sensors 51[#1] and 51[#4] is determined to be abnormal in the second determination process, limiting engine power through the power limiting process may be executed in a manner in which the degree of limiting engine power is smaller than that at the time when the execution mode A is selected or that at the time when the execution mode B is selected. When the execution mode C is selected, injection pressure control is accurately executed in comparison with when the execution mode A or the execution mode B is selected, so there is a small request to execute fail-safe control, specifically, a small request to limit engine power. With the above-described device, it is possible to reduce the degree of limiting engine power through the power limiting process when the execution mode C is selected, so it is possible to suppress an unnecessary reduction in engine power and, by extension, an unnecessary decrease in the power performance of the internal combustion engine 10.

As long as two or more of the pressure sensors 51 are connected to the second processing unit 42 and the pressure sensors 51 larger in number than the pressure sensors 51 connected to the second processing unit 42 are connected to the first processing unit 41, it is possible to arbitrarily change the number of pressure sensors connected to the first processing unit 41 and the number of pressure sensors connected to the second processing unit 42.

The device according to the above-described embodiment is applicable by modifying the components as needed as long as the device executes the process associated with fuel injection based on the fuel pressure PQ with the use of the first processing unit 41 and the second processing unit 42. Such a device may be, for example, a device that executes a process associated with injection pressure control with the use of the first processing unit and a process associated with injection amount control with the use of the second processing unit. Other than the above, such a device may be, for example, a device that executes mutually different processes associated with injection pressure control with the use of the respective processing units or a device that executes mutually different processes associated with injection amount control with the use of the respective processing units.

As long as it is possible to properly detect a pressure that is an index of the fuel pressure inside each fuel injection valve 20 (specifically, inside each nozzle chamber 25), in other words, a fuel pressure that varies with a variation in the fuel pressure inside each fuel injection valve 20, it is not limited to direct installation of the pressure sensor 51 to each fuel injection valve 20. A manner of installing each pressure sensor 51 may be arbitrarily changed. Specifically, each pressure sensor 51 may be installed at a portion (branch passage 31*a*) between the common rail 34 and the corresponding fuel injection valve 20 in the fuel supply passage.

Instead of the fuel injection valve 20 that is driven by the piezoelectric actuator 29, for example, a fuel injection valve that is driven by an electromagnetic actuator that includes, for example, a solenoid coil, and the like, may be employed.

The invention may be applied to an internal combustion engine that includes four cylinders. Instead, the invention may also be applied to an internal combustion engine that includes three cylinders or an internal combustion engine that includes five or more cylinders. The invention is not limited to a diesel engine. The invention may also be applied to a gasoline engine that uses gasoline fuel or a natural gas engine that uses natural gas fuel.

The invention claimed is:

1. A control device for an internal combustion engine, the control device comprising:

a plurality of pressure sensors, each of which detects a fuel pressure in a fuel supply system;

an electronic control unit comprising a first processing unit and a second processing unit, the first processing unit configured to execute a first determination process that determines whether there is an abnormality in the plurality of pressure sensors;

the second processing unit:

(i) connected to two or more pressure sensors which are a part of the plurality of pressure sensors, (ii) configured to execute a second determination process that determines whether there is an abnormality in the two or more pressure sensors, and (iii) configured to execute a control process associated with fuel injection based on detected values of the two or more pressure sensors; and the electronic control unit configured to:

(iv) execute a power limiting process for limiting engine power when the number of the pressure sensors determined to be normal in the second determination process is smaller than or equal to one, and, (v) when only one pressure sensor is determined to be normal in the second determination process and when the pressure sensor determined to be normal and one of the pressure sensors connected to only the first processing unit are determined to be normal in the first determination process, execute the control process based on the detected value of the pressure sensor determined to be normal in the second determination process, and to reduce a degree of limiting engine power through the power limiting process compared with when all the pressure sensors connected to only the first processing unit are determined to be abnormal in the first determination process.

2. The control device according to claim 1, wherein the internal combustion engine includes three or more cylinders, and the pressure sensors are respectively provided for the cylinders of the internal combustion engine one by one, the first processing unit is connected to all the pressure sensors and configured to execute a process associated with injection amount control based on the detected values of those pressure sensors, and the second processing unit is connected to two of the pressure sensors and configured to execute a process associated with injection pressure control based on the detected values of those pressure sensors as the control process.

3. The control device according to claim 1, wherein the electronic control unit is configured to reduce the degree of limiting the engine power by prohibiting limiting the engine power through the power limiting process.

4. The control device according to claim 1, wherein the electronic control unit is configured to increase the degree of limiting the engine power in the power limiting process when there is no pressure sensor determined to be normal in the second determination process as compared with when only one of the pressure sensors is determined to be normal in the second determination process.

5. The control device according to claim 1, wherein when a determination result made in the first determination process does not agree with a determination result made in the second determination process, the electronic control unit is configured to determine that there is an abnormality in an electronic control unit that incorporates the first processing unit and the second processing unit.

6. A control method for an internal combustion engine that includes: a plurality of pressure sensors; a first processing unit that is connected to the plurality of pressure sensors; a second processing unit that is connected to at least two or more pressure sensors, which are part of the plurality of pressure sensors, the control method comprising:

detecting, with the plurality of pressure sensors, a fuel pressure in a fuel supply system;

determining, by the first processing unit, whether there is an abnormality in the plurality of pressure sensors:

executing, by the second processing unit, a control process associated with fuel injection based on detected values of the at least two or more pressure sensors;

determining, by the second processing unit, whether there is an abnormality in the at least two or more pressure sensors:

executing a power limiting process for limiting engine power when the number of the pressure sensors determined to be normal is smaller than or equal to one among the at least two or more pressure sensors connected to the second processing unit; and when only one of the at least two or more pressure sensors connected to the second processing unit is normal and one of the pressure sensors connected to only the first processing unit is normal, executing the control process on the basis of the detected value of the normal one of the at least two pressure sensors connected to the second processing unit, and reducing a degree of limiting engine power through the power limiting process as compared with when all the pressure sensors connected to only the first processing unit are abnormal.

* * * * *